US009305524B2

(12) United States Patent
Satoh

(10) Patent No.: US 9,305,524 B2
(45) Date of Patent: Apr. 5, 2016

(54) ELECTRONIC MUSICAL INSTRUMENT

(71) Applicant: Kabushiki Kaisha Kawai Gakki Seisakusho, Hamamatsu-shi, Shizuoka-ken (JP)

(72) Inventor: Takuya Satoh, Hamamatsu (JP)

(73) Assignee: Kabushiki Kaisha Kawai Gakki Seisakusho, Hamamatsu-shi (JP)

( * ) Notice: Subject to any disclaimer, the term of this patent is extended or adjusted under 35 U.S.C. 154(b) by 0 days.

(21) Appl. No.: 14/835,367

(22) Filed: Aug. 25, 2015

(65) Prior Publication Data

US 2016/0071497 A1 Mar. 10, 2016

(30) Foreign Application Priority Data

Sep. 9, 2014 (JP) ..... 2014-182877

(51) Int. Cl.
*G10H 3/00* (2006.01)
*G10C 1/02* (2006.01)

(52) U.S. Cl.
CPC ..... *G10C 1/02* (2013.01)

(58) Field of Classification Search
CPC ..... G10C 3/06; G10C 1/02; G10H 2230/011
USPC ..... 84/192, 195, 212, 723
See application file for complete search history.

(56) References Cited

U.S. PATENT DOCUMENTS

| | | | | |
|---|---|---|---|---|
| 6,281,419 | B1 * | 8/2001 | Arimori | 84/438 |
| 2007/0017353 | A1 * | 1/2007 | Kunisada et al. | 84/723 |
| 2007/0028752 | A1 * | 2/2007 | McGrew | 84/726 |
| 2008/0127798 | A1 * | 6/2008 | Sato et al. | 84/192 |
| 2012/0006185 | A1 * | 1/2012 | Mishima et al. | 84/744 |
| 2013/0061733 | A1 * | 3/2013 | Ohnishi et al. | 84/174 |
| 2014/0202318 | A1 * | 7/2014 | Ohnishi et al. | 84/723 |
| 2015/0163571 | A1 * | 6/2015 | Satomi et al. | 381/162 |
| 2015/0163575 | A1 * | 6/2015 | Ohnishi | 381/386 |
| 2015/0206514 | A1 * | 7/2015 | Ohnishi et al. | 84/725 |

FOREIGN PATENT DOCUMENTS

JP 2013-77000 4/2013

* cited by examiner

*Primary Examiner* — Jeffrey Donels
(74) *Attorney, Agent, or Firm* — Lewis Roca Rothgerber Christie LLP

(57) ABSTRACT

An electronic musical instrument capable of suppressing resonance of a soundboard and reducing a peak dip of the frequency characteristic of a musical tone to enable excellent musical sound to be obtained. The soundboard has first and second ends which extend parallel to each other. The first and second ends are secured to a predetermined part of the instrument by first screws and second screws. A vibration exciter is provided on the soundboard and driven according to a musical tone signal to vibrate the soundboard to cause the soundboard to generate a musical tone. The first and second screws are arranged along the respective first and second ends in a staggered manner such that each first screw and each first screw are not opposed to each other in symmetrical relation in a direction orthogonal to the first and second ends.

3 Claims, 8 Drawing Sheets

ELECTRONIC MUSICAL INSTRUMENT

CROSS-REFERENCE TO RELATED APPLICATION(S)

This application claims priority of Japanese Patent Application No. 182877/2014, filed on Sep. 9, 2014, the entire content of which is incorporated herein by reference.

BACKGROUND OF THE INVENTION

1. Field of the Invention

The present invention relates to an electronic musical instrument that generates a musical tone according to a musical tone signal generated based on an operated state of an operating element for musical performance.

2. Description of the Related Art

As a conventional electronic musical instrument of the above-mentioned type, there has been known one disclosed e.g. in Japanese Laid-Open Patent Publication (Kokai) No. 2013-77000. This conventional electronic musical instrument is formed by adding functions of an electronic piano to an acoustic upright piano. The electronic musical instrument is provided with a keyboard, a soundboard, a vibration exciter, and a controller, and has a plurality of operation modes including a weak tone mode. In the weak tone mode, key depression information is detected by a sensor, and a detection signal indicative of the key depression information is input to the controller. The controller, which is implemented e.g. by a CPU, drives the vibration exciter according to the key depression information detected by the sensor. This causes the vibration exciter to vibrate the soundboard, whereby a musical tone is generated.

As shown in FIG. 8, an upright electronic piano constructed as above generally has a soundboard SB formed in a rectangular shape, and upper, lower, right, and left ends of the soundboard SB are secured to the front surface of a rim FR of the electronic piano by upper screws UB, lower screws DB, left screws LB, and right screws RB, respectively. Note that in FIG. 8, each of the upper to right screws UB to RB is illustrated on a slightly enlarged scale for convenience' sake.

The upper screws UB and the lower screws DB are arranged such that the location of each of the upper screws UB and the location of each of the lower screws DB are opposed to each other in symmetrical relation in a vertical direction, and the left screws LB and the right screws RB are arranged such that the location of each of the left screws LB and the location of each of the right screws RB are opposed to each other in symmetrical relation in a horizontal direction. For this reason, the conventional upright electronic piano suffers from the following problem: The screws UB to RB for use in mounting the soundboard SB are arranged as above and consequently the fixed ends of the upper, lower, right, and left ends of the soundboard SB are regularly positioned, and hence when the soundboard SB is caused to be vibrated by the vibration exciter in accordance with key depression, the soundboard SB easily resonates, which causes a large peak dip in the frequency characteristic of a musical tone, so that it is impossible to obtain excellent musical sound.

SUMMARY OF THE INVENTION

It is an object of the present invention to provide an electronic musical instrument which is capable of suppressing resonance of a soundboard and consequently reducing a peak dip of a frequency characteristic of a musical tone to thereby provide excellent musical sound.

To attain the above object, the present invention provides an electronic musical instrument that generates a musical tone according to a musical tone signal generated based on an operated state of an operating element for musical performance, comprising a soundboard having a first end and a second end extending parallel to each other and secured to a predetermined part of the electronic musical instrument by a plurality of first screws and a plurality of second screws, respectively, and a vibration exciter provided on the soundboard and configured to vibrate the soundboard by being driven according to the musical tone signal, to thereby cause the soundboard to generate a musical tone, wherein the plurality of first screws and the plurality of second screws are arranged along the respective first and second ends in a staggered manner such that a location of each of the plurality of first screws and a location of each of the plurality of second screws are not opposed to each other in symmetrical relation in a direction orthogonal to the first and second ends.

With the construction of the electronic musical instrument according to the present invention, the vibration exciter vibrates the soundboard by being driven according to a musical tone signal, to thereby cause the soundboard to generate a musical tone. Further, the first and second ends of the soundboard, which extend parallel to each other, are secured to the predetermined part of the electronic musical instrument by the first screws and the second screws, respectively, and the first screws and the second screws are arranged along the respective first and second ends in a staggered manner such that the location of each of the first screws and that of each of the second screws are not opposed to each other in symmetrical relation in the direction orthogonal to the first and second ends. Differently from the conventional electronic musical instrument described hereinbefore, according to the present invention, the fixed ends of each of the first and second ends of the soundboard are irregularly arranged as described above, so that it is possible to suppress the resonance of the soundboard and thereby reduce the peak dip of the frequency characteristic of a musical tone to enable excellent musical sound to be obtained.

Preferably, a cushion for suppressing resonance of the soundboard is disposed between the vibration exciter and the soundboard.

With the construction of this preferred embodiment, since the cushion for suppressing resonance of the soundboard is disposed between the vibration exciter and the soundboard, the resonance of the soundboard can be further suppressed, which makes it possible to obtain more excellent musical sound.

Preferably, the electronic musical instrument is an upright electronic piano in which the operating element is a key; the soundboard is formed in a rectangular shape, and the first and second ends correspond to an upper end and a lower end of the soundboard, respectively; the plurality of first screws and the plurality of second screws are arranged along the respective upper and lower ends in a staggered manner such that a location of each of the first screws and a location of each of the second screws are not opposed to each other in symmetrical relation in a vertical direction; a left end and a right end of the soundboard are secured to the predetermined part by a plurality of third screws and a plurality of fourth screws, respectively; and the plurality of third screws and the plurality of fourth screws are arranged along the respective left and right ends in a staggered manner such that a location of each of the third screws and a location of each of the fourth screws are not opposed to each other in symmetrical relation in a left-right direction.

With the construction of this preferred embodiment, the upper and lower ends of the soundboard in a rectangular shape are secured to the predetermined part by the plurality of first screws and the plurality of second screws, respectively, and the left and right ends of the soundboard are secured to the predetermined part by the plurality of third screws and the plurality of fourth screws, respectively. Further, the plurality of first screws and the plurality of second screws are arranged along the respective upper and lower ends in a staggered manner such that the location of each of the first screws and that of each of the first second screws are not opposed to each other in symmetrical relation in the vertical direction, and the plurality of third screws and the plurality of fourth screws are arranged along the respective left and right ends in a staggered manner such that the location of each of the third screws and that of each of the fourth screws are not opposed to each other in symmetrical relation in the left-right direction. Thus, the fixed ends of each of the upper, lower, left, and right ends are irregularly arranged, so that the resonance of the soundboard of the upright electronic piano can be appropriately suppressed, which makes it possible to obtain excellent musical sound.

The above and other objects, features, and advantages of the present invention will become more apparent from the following detailed description taken in conjunction with the accompanying drawings.

DETAILED DESCRIPTION OF PREFERRED EMBODIMENTS

Figure 1:
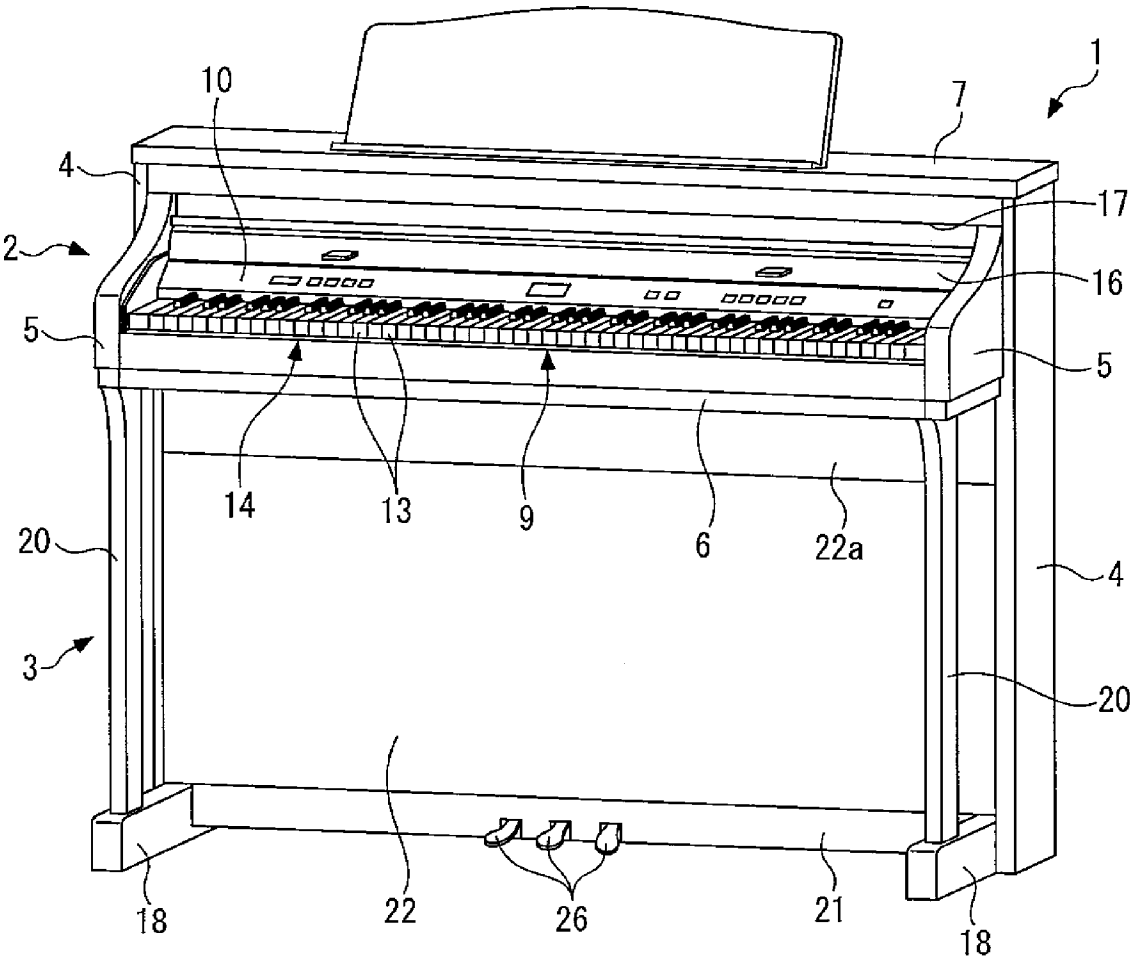
FIG. 1 is a perspective view of an upright electronic piano according to an embodiment of the present invention.
Figure 2:
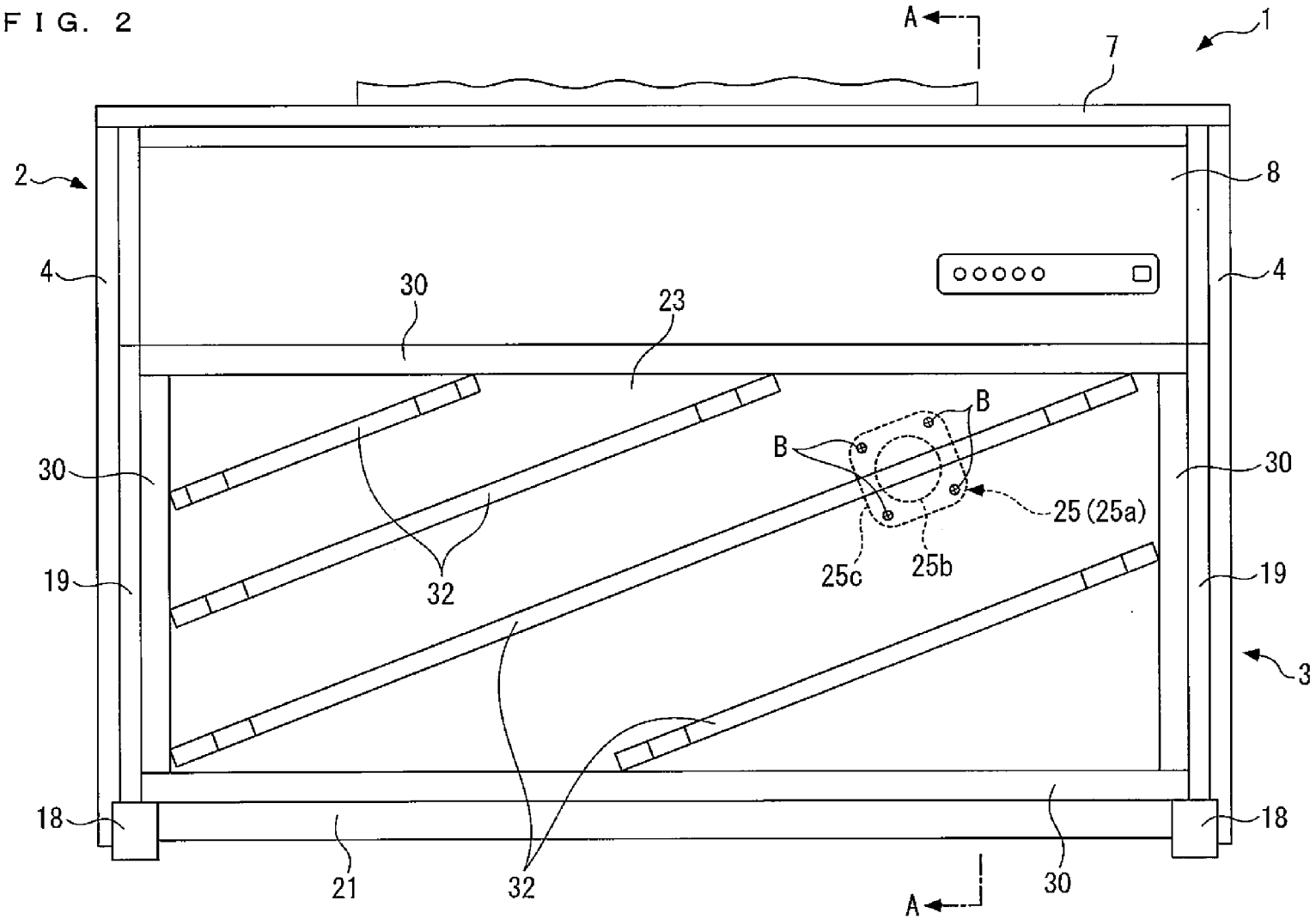
FIG. 2 is a rear view of the electronic piano shown in FIG. 1.
Figure 3:
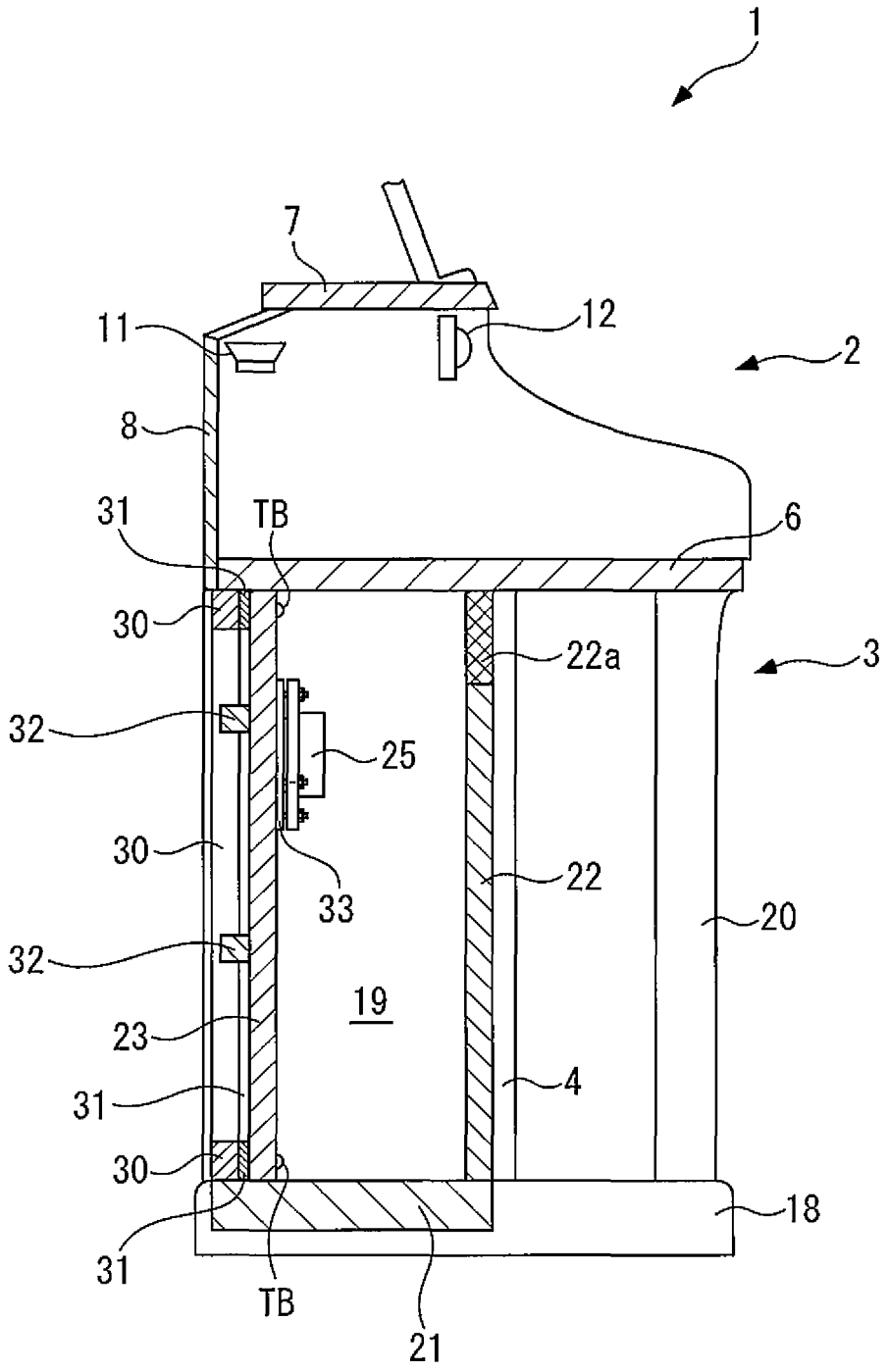
FIG. 3 is a cross-sectional view taken on line A-A of FIG. 2.

The present invention will now be described in detail with reference to the drawings showing a preferred embodiment thereof. As shown in FIGS. 1 to 3, an upright electronic piano 1 (electronic musical instrument) according to the present embodiment is comprised of a piano body 2 and a stand unit 3 for supporting the piano body 2. In the following description, a near side, a far side, a left side, and a right side, as viewed from the player, of the electronic piano will be referred to as "front", "rear", "left", and "right", respectively.

On the left and right sides of the piano body 2 and the stand unit 3, there are mounted end panels 4 and 4, respectively, in a manner covering the piano body 2 and the stand unit 3. The piano body 2 has an exterior formed by left and right arms 5 and 5, a keybed 6 extending horizontally between the lower ends of the respective arms 5 and 5, a topboard 7 extending horizontally between the upper ends of the respective arms 5 and 5, and a back plate 8 for covering between the rear ends of the respective arms 5 and 5. Within the piano body 2, there are disposed a keyboard device 9, an operation panel 10, middle and high-pitched sound loudspeakers 11, and high-pitched sound loudspeakers 12.

The keyboard device 9 is comprised of a keyboard 14 having a plurality of keys 13 (operating elements) arranged side by side in the left-right direction on the keybed 6, a plurality of hammers (not shown) provided for the respective keys 13 and each configured to pivotally move in accordance with key depression of an associated key 13, and a plurality of key sensors (not shown) provided for the respective keys 13 and each configured to detect key depression information of an associated key 13. The key 13 is basically made of a wood material and has substantially the same construction as that of a key of an acoustic upright piano. The key 13 is pivotally supported at its center. The key sensor is formed e.g. by a rubber switch and detects execution/non-execution (on/off) and key depression speed (velocity) of depression of an associated key 13 via a hammer that pivotally moves in accordance with depression of the associated key 13. Note that in FIG. 1, some of reference numerals of the keys 13 are omitted for convenience' sake.

The operation panel 10 is disposed above the keyboard 14, and is provided with operation buttons and levers for use in setting a tone color, a tone volume, an acoustic effect, etc. for the electronic piano 1, and a display for displaying the settings.

The middle and high-pitched sound loudspeakers 11 are formed by four mid-range loudspeakers, and each basically reproduce a middle and high-pitched sound component of a musical tone. The loudspeakers 11 are disposed in the upper left and right rear ends of the piano body 2, with their sound emission surfaces facing upward. The high-pitched sound loudspeakers 12 are formed by two dome tweeters and each basically reproduce a high-pitched sound component of a musical tone. The loudspeakers 12 are disposed in the upper left and right ends of the piano body 2, in facing relation to an opening 17 (see FIG. 1) for sliding of a fallboard 16 and with their sound emission surfaces facing forward.

The stand unit 3 is a box-shaped assembly formed by left and right toe blocks 18 and 18, left and right side boards 19 and 19, left and right legs 20 and 20, a toe rail 21, a lower panel 22, a soundboard 23, and so forth. On the soundboard 23, there is provided a vibration exciter 25 for vibrating the soundboard 23 to thereby cause the same to generate a musical tone. The soundboard 23 and the vibration exciter 25 form a soundboard speaker.

The toe rail 21 is connected between the rear ends of the respective toe blocks 18 and 18 and extend in the left-right direction, with three pedals 26 pivotally movably provided in a central portion thereof (see FIG. 1). Each of the pedals 26 is provided with a pedal sensor (not shown) for detecting execution/non-execution (on/off) of operation of the pedal 26. Note that in FIG. 3, the pedals 26 are omitted for convenience' sake. The lower panel 22 is made of a wood material and is formed in a rectangular shape. The lower panel 22 is disposed in a manner covering the front end of a space enclosed by the keybed 6, the toe rail 21, and the left and right side panels 19 and 19 (the space will be hereinafter referred to as "the stand space"). Further, the lower panel 22 has an upper portion thereof formed with a laterally elongated opening for guiding a musical tone forward from the soundboard speaker. This opening is covered by a mesh cover 22*a*.

Similar to the soundboard of an acoustic upright piano, the soundboard 23 is formed in a laterally elongated rectangular shape by joining a plurality of solid wood board materials e.g. of spruce. A rim 30 (predetermined part) is mounted along the outer periphery of the rear end of the stand space, and the soundboard 23 is secured to the front surface of the rim 30 as follows: Each of the upper, lower, left, and right ends of the soundboard 23 has a plurality prepared holes (not shown) formed therein in parallel with each other, and each prepared hold extends through the soundboard 23 in the front-rear direction. The rim 30 has a plurality prepared holes (not shown) formed therein in a manner associated with the respective prepared holes of the soundboard 23 and each prepared hole of the rim 30 extends in the front-rear direction. The soundboard 23 is secured to the front surface of the rim 30 by screwing a tapping screw TB (each of first to fourth screws) into each of the prepared holes of the soundboard 23 and an associated one of the prepared holes of the rim 30 from the front side in the mentioned order. The soundboard 23 is disposed parallel to the lower panel 22 in a manner opposed to the lower panel 22 and covers the rear end of the stand space, without any gap.

Figure 5:
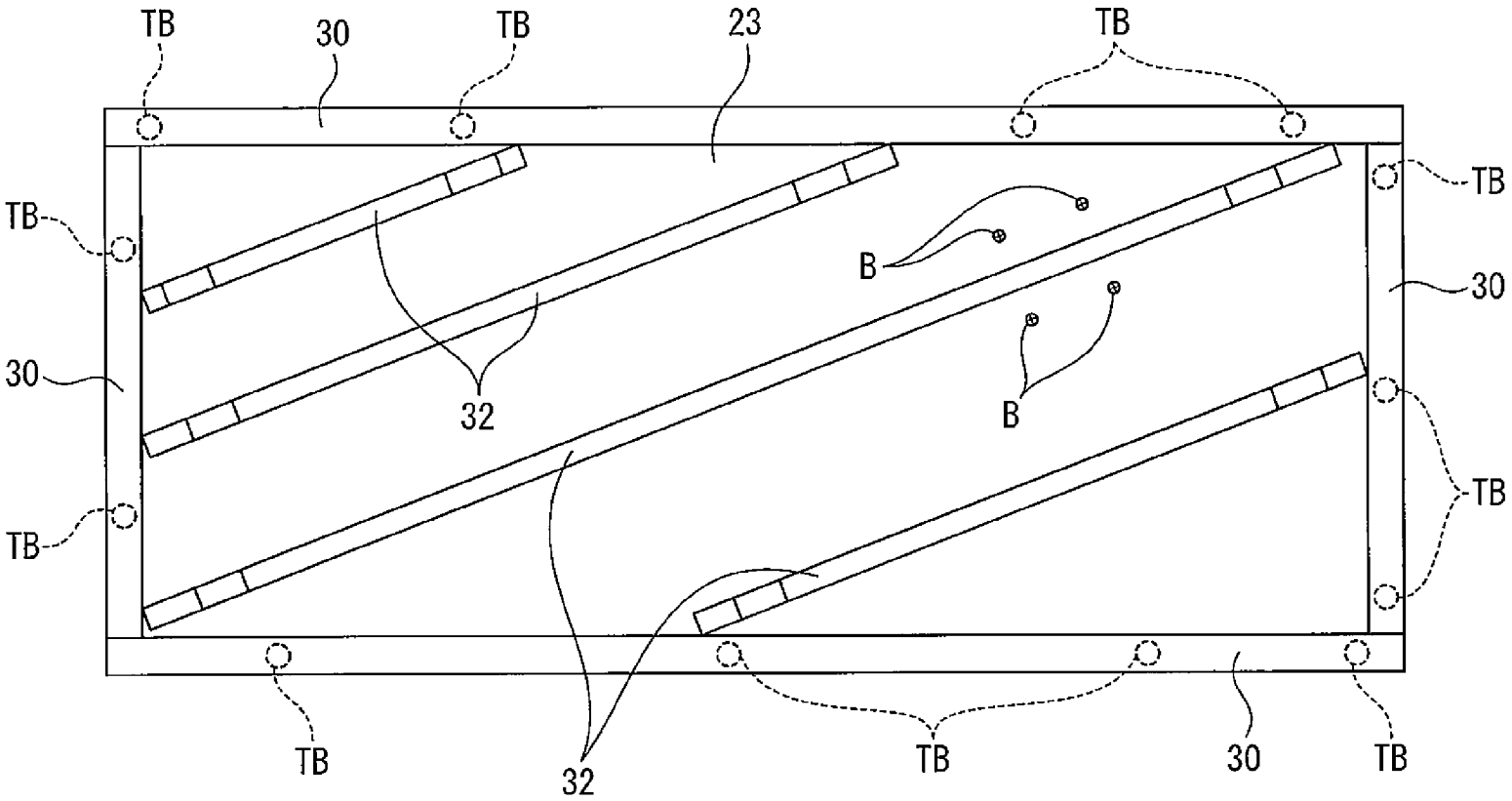
FIG. 5 is a view useful in explaining locations of respective tapping screws for securing therewith a soundboard of the electronic piano in FIG. 1.

FIG. 5 shows the locations of the tapping screws TB on the soundboard 23. As shown in FIG. 5, the tapping screws TB for securing the upper end of the soundboard 23 and the tapping screws TB for securing the lower end of the soundboard 23 are arranged along the respective upper and lower ends of the soundboard 23 in a staggered manner such that the location of each of the tapping screws TB on the upper end and that of each of the tapping screws TB on the lower end are not opposed to each other in symmetrical relation in the vertical direction. Further, the tapping screws TB for securing the left end of the soundboard 23 and the tapping screws TB for securing the right end of the soundboard 23 are arranged along the respective left and right ends of the soundboard 23 in a staggered manner such that the location of each of the tapping screws TB on the left end and that of each of the tapping screws TB on the right end are not opposed to each other in symmetrical relation in the left-right direction. Note that in FIG. 5, each of the tapping screws TB is illustrated on a slightly enlarged scale for convenience' sake.

Further, the number of tapping screws TB for securing the upper end of the soundboard 23 and the number of tapping screws TB for securing the lower end of the same are each set to four, and the number of tapping screws TB for securing the left end of the soundboard 23 and the number of the tapping screws TB for securing the right end of the soundboard 23 are set to two and three, respectively. However, this is only an example, and the numbers of tapping screws TB can be set as desired.

Figure 4:
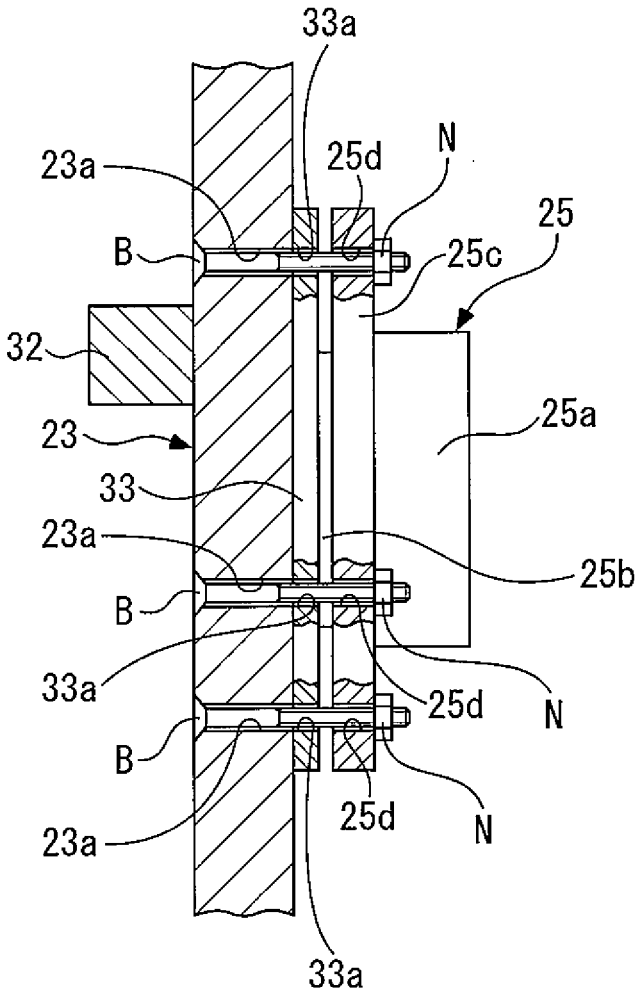
FIG. 4 is an enlarged cross-sectional view, partly broken away, of a vibration exciter and so forth.

Further, between the soundboard 23 and the rim 30, there is disposed a soundboard cushion 31 for suppressing resonance of the soundboard 23. The soundboard cushion 31 is formed e.g. of PORON (model number: HH-48) manufactured by Rogers Inoac Corporation. The soundboard cushion 31 is formed in a board shape, and the thickness thereof is set, by experiment or the like, to a predetermined value according to the resonance characteristic (natural frequency) of the soundboard 23. Further, on the rear surface of the soundboard 23, there are mounted a plurality of sound ribs 32. The sound ribs 32 serve to enhance the transmission rate of vibration on the soundboard 23, and extend parallel to each other. Furthermore, in the soundboard 23, at a predetermined location slightly closer to the low-pitched range side with respect to the center thereof, there are formed a plurality of mounting holes 23*a* (see FIG. 4) for use in mounting the vibration exciter 25, and each mounting hole 23*a* extends through the soundboard 23 in the front-rear direction. The number of the mounting holes 23*a* is set e.g. to four, and only three of them are shown in FIG. 4. Note that FIG. 4 shows a different cross-section from that shown in FIG. 3.

The vibration exciter 25 is e.g. an electromagnetic-type vibration exciter having a vibration characteristic that it vibrates in a predetermined frequency band (e.g. 30 Hz to 2 kHz), and is comprised of a body part 25*a* and an excitation part 25*b* for imparting vibration to the soundboard 23, as shown in FIGS. 2 and 4. The body part 25*a* has a flange 25*c* protruding outward from the outer peripheral surface of a bottom (rear end) thereof. The flange 25*c* has a planar surface, which is orthogonal to the front-rear direction, formed in a rectangular shape, and has four corners (see FIG. 2). Further, the four corners of the flange 25*c* are formed with insertion holes 25*d*, respectively (only three of which are shown in FIG. 4), and each insertion hole 25*d* extends through the flange 25*c* in the front-rear direction.

Between the soundboard 23 and the vibration exciter 25, there is disposed a vibration exciter cushion 33 for suppressing the resonance of the soundboard 23. The vibration exciter cushion 33 is formed e.g. of PORON (model number: HH-48). The vibration exciter cushion 33 is formed in a board shape, and the thickness thereof is set, by experiment or the like, e.g. to 6 mm, according to the resonance characteristic of the soundboard 23. Further, the vibration exciter cushion 33 is formed with a plurality of insertion holes 33*a* in a manner associated with the respective insertion holes 25*d* of the vibration exciter 25, and each insertion hole 33*a* extends through the vibration exciter cushion 33 in the front-rear direction. The number of the insertion holes 33*a* is set to four, and only three of them are shown in FIG. 4. A countersunk screw B is inserted into each of the mounting holes 23*a* of the soundboard 23, the associated one of the insertion holes 33*a* of the vibration exciter cushion 33, and the associated one of the insertion holes 25*d* of the vibration exciter 25 from the rear side in the mentioned order, and nuts N are fastened on the respective countersunk screws B from the front side, whereby the vibration exciter 25 is secured to the front surface of the soundboard 23.

Further, the electronic piano 1 is provided with a tone generator implemented by an ECU including a CPU, a RAM, and a ROM (none of which are shown). Detection signals from the aforementioned key sensors and pedal sensors are input to this tone generator. The tone generator generates a drive signal, according to a program stored in the ROM in response to the input detection signals, and then inputs the generated drive signal to the vibration exciter 25. This causes the vibration exciter 25 to be driven by the drive signal generated based on a depressed state of a key 13 and others, whereby the soundboard 23 is vibrated, thereby generating musical tones.

Figure 6:
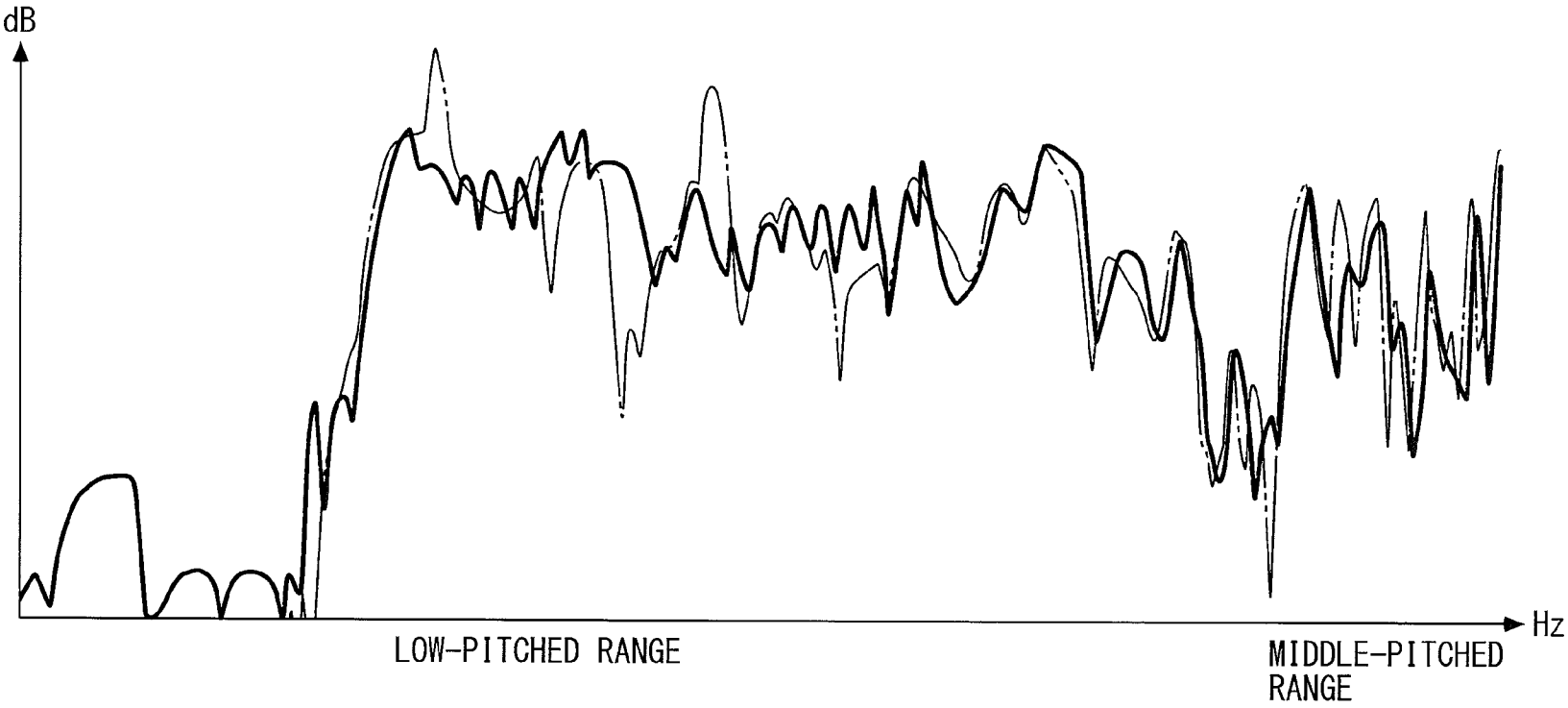
FIG. 6 is a diagram showing the relationship between the frequency of a musical tone generated by the electronic piano shown in FIG. 1 and the sound pressure of the same, together with a comparative example.
Figure 8:
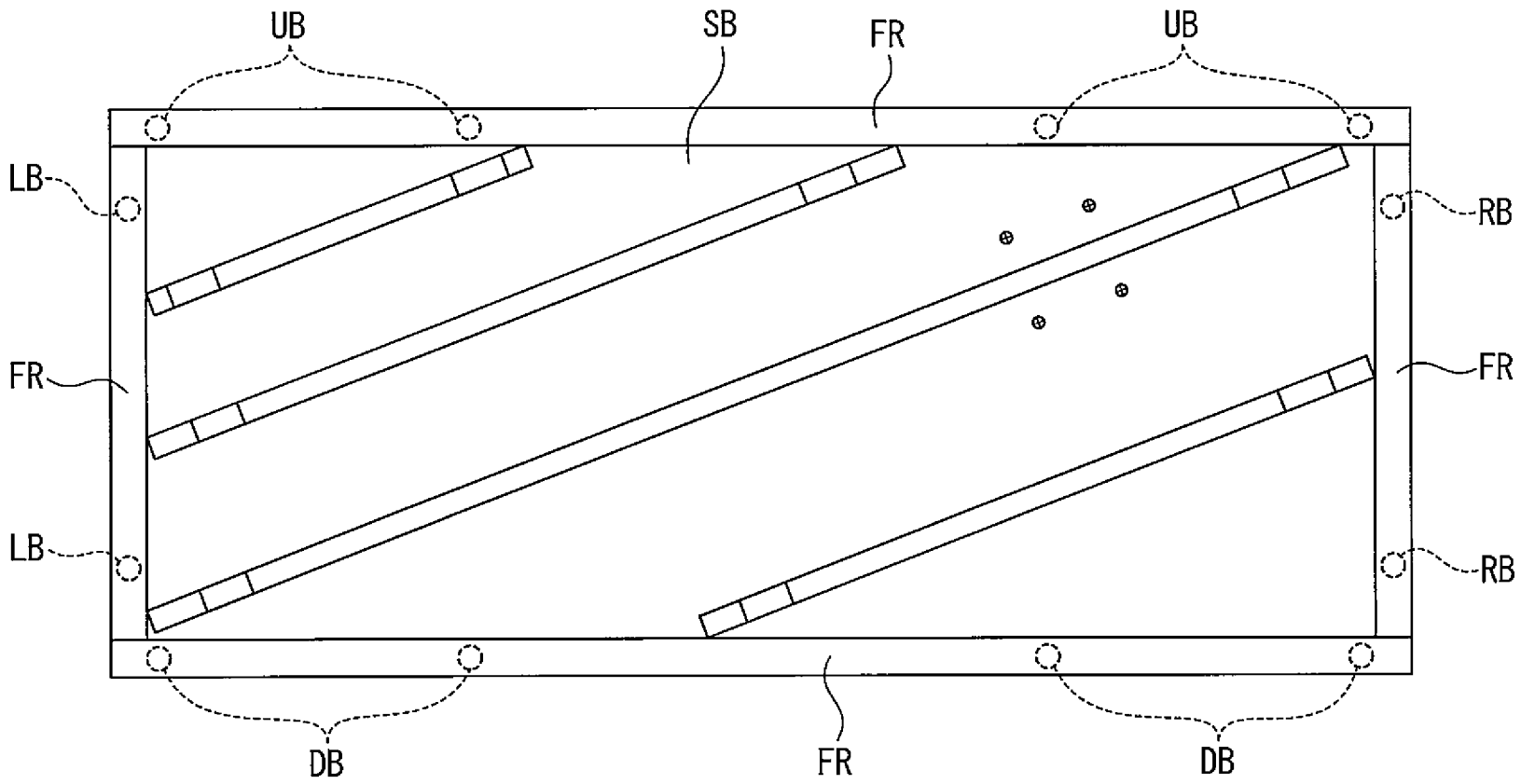
FIG. 8 is a view useful in explaining locations of respective tapping screws for securing therewith a soundboard of a conventional upright electronic piano.

FIG. 6 shows the relationship (indicated by a thick solid line) between frequency (Hz) and sound pressure (dB) of a musical tone from the electronic piano 1, which were measured immediately in front of a center of the soundboard 23, together with a comparative example (indicated by a thin two-dot chain line). The comparative example shows a case where differently from the present embodiment, the screws for securing the soundboard are arranged regularly as shown in FIG. 8. In FIG. 6, the frequency is shown logarithmically. As shown in FIG. 6, according to the present embodiment, it is possible to reduce the peak dip of the frequency characteristic of a musical tone mainly in a lower-pitched range in comparison with the case of the comparative example.

As described above, according to the present embodiment, each of the upper, lower, left, and right ends of the soundboard 23 formed in a rectangular shape is secured to the rim 30 by the plurality of tapping screws TB, and as described with reference to FIG. 5, the tapping screws TB for securing the upper end of the soundboard 23 and the tapping screws TB for securing the lower end of the soundboard 23 are arranged along the respective upper and lower ends of the soundboard 23 in a staggered manner such that the location of each of the tapping screws on the upper end and the location of each of the tapping screws on the lower end are not opposed to each other in symmetrical relation in the vertical direction. Further, the tapping screws TB for screwing the left end of the soundboard 23 and the tapping screws TB for screwing the right end of the soundboard 23 are arranged along the respective left and right ends of the soundboard 23 in a staggered manner such that the location of each of the tapping screws on the left end and the location of each of the tapping screws on the right end are not opposed to each other in symmetrical relation in the left-right direction.

As described above, differently from the conventional electronic musical instrument described hereinbefore, the fixed ends of each of the upper, lower, left, and right ends of the soundboard 23 are irregularly arranged, and hence it is possible to appropriately suppress the resonance of the soundboard 23 and thereby appropriately reduce the peak dip of the frequency characteristic of a musical tone to thereby enable excellent musical sound to be obtained. Further, since the vibration exciter cushion 33 for suppressing the resonance of the soundboard 23 is disposed between the vibration exciter 25 and the soundboard 23, the resonance of the soundboard 23 can be further suppressed, which makes it possible to obtain more excellent musical sound.

It should be noted that the present invention is not limited to the above-described embodiment, but can be practiced in various forms. For example, although in the above-described embodiment, the number of the vibration exciter 25 is set to one, it is possible to provide two or more vibration exciters. In this case, the vibration exciters having respective vibration characteristics different from each other may be provided for the high-pitched range, the middle-pitched range, and the low-pitched range, respectively. Further, although in the above-described embodiment, the soundboard cushion 31 is formed of PORON, any other material, such as urethane foam or rubber, which is suitable for suppressing the resonance of the soundboard 23 may be used. This variation of the soundboard cushion 31 similarly applies to the vibration exciter cushion 33.

Furthermore, although in the above-described embodiment, the soundboard cushion 31 and the vibration exciter cushion 33 are provided, at least one of the cushions 31 and 33 may be dispensed with. What is more, although in the above-described embodiment, the tapping screws TB for securing the upper, lower, left, and right ends of the soundboard 23 are arranged irregularly as described above, the tapping screws for securing either the upper and lower ends or the left and right sides may be irregularly arranged and also the tapping screws for securing the other of the upper and lower ends and the left and right sides may be regularly arranged as shown in FIG. 8.

Further, although in the above-described embodiment, the tapping screw TB are used as screws for securing the soundboard 23, general nuts and bolts may be used. In this case, for example, each of the nuts is securely embedded in the rim, and then the bolts are inserted into the respective insertion holes of the soundboard from the front side and are fastened in the respective nuts, whereby the soundboard is secured to the rim. Alternatively, each of the bolts is securely embedded in the rim and inserted into an associated one of the insertion holes of the soundboard from the rear side, and then the nuts are fastened on the respective bolts from the front side, whereby the soundboard is secured to the rim. In these cases, the bolts and nuts correspond to first to fourth screws of the present invention.

Figure 7:
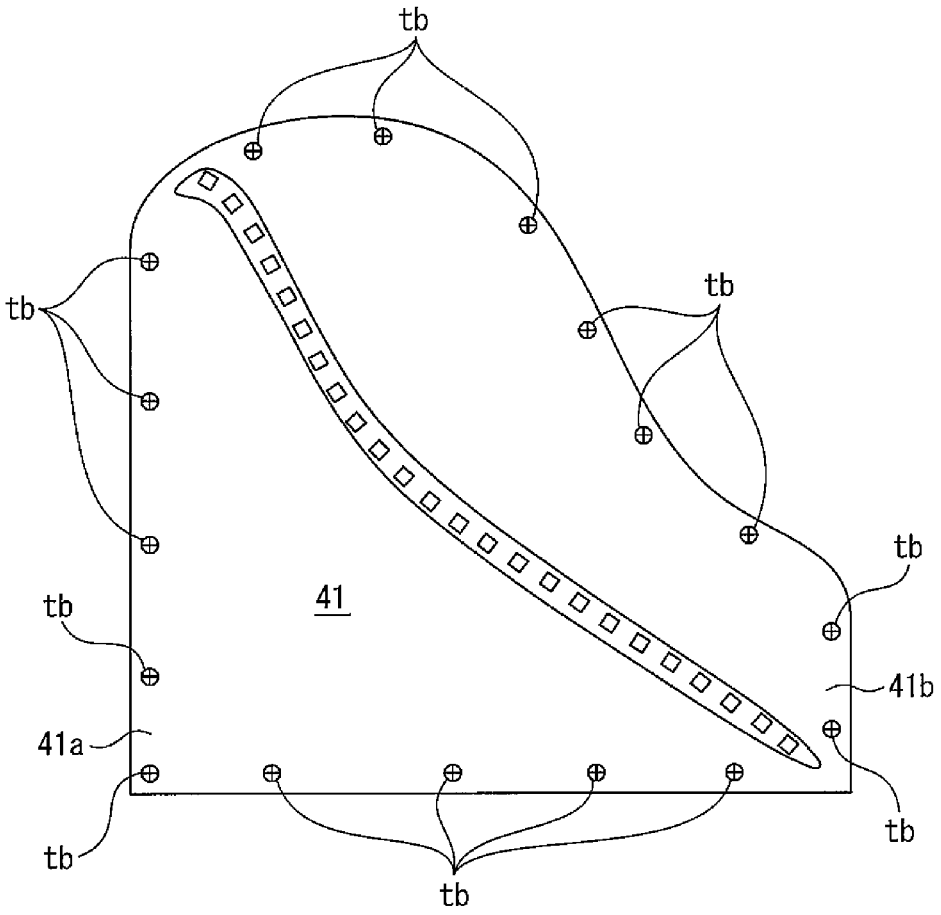
FIG. 7 is a schematic plan view of a soundboard of a grand electronic piano to which the present invention is applied.

Although in the above-described embodiment, the present invention is applied to the upright electronic piano 1, it is to be understood that the invention can also be applied to a grand electronic piano, as well as to any other suitable electronic musical instrument, such as a percussion-type electronic musical instrument. FIG. 7 schematically shows a soundboard 41 of a grand electronic piano to which is applied the present invention.

As shown in FIG. 7, the soundboard 41 has a periphery thereof secured to an inner rim (not shown) by a plurality of tapping screws tb (first and second screws). On the bottom surface of the soundboard 41, there is mounted a vibration exciter (not shown) for vibrating the soundboard 41, and between the soundboard 41 and the inner rim and between the soundboard 41 and the vibration exciter, there are disposed, respectively, a soundboard cushion and a vibration exciter cushion (neither of which are shown) each for suppressing resonance of the soundboard 41. The soundboard 41 has left and right ends 41*a* and 41*b* (first and second ends) extending parallel to each other in the front-rear direction, and the tapping screws tb for securing a front portion of the left end 41*a* and the tapping screws tb for securing the right end 41*b* are arranged along the respective left and right ends 41*a* and 41*b* of the soundboard 41 in a staggered manner such that the location of each of the tapping screws on the left end 41*a* and that of each of the tapping screws on the right end 41*b* are not opposed to each other in symmetrical relation in the left-right direction.

Thus, in the grand electronic piano as well, the fixed ends of each of the left and right ends 41*a* and 41*b* are irregularly positioned as described above, so that it is possible to suppress resonance of the soundboard 41 and thereby reduce the peak dip of the frequency characteristic of a musical tone to thereby enable excellent musical sound to be obtained. Further, since the vibration exciter cushion is disposed between the vibration exciter and the soundboard 41, the resonance of the soundboard 41 can be further suppressed, which makes it possible to obtain more excellent musical sound.

Incidentally, it is to be understood that also in the grand electronic piano to which the present invention is applied, at least one of the soundboard cushion and the vibration exciter cushion may be dispensed with. Further, general nuts and bolts may be used in place of the tapping screws tb. In this case, for example, each of the nuts is securely embedded in the inner rim, and then the bolts are inserted into the respective insertion holes of the soundboard from above and are fastened in the respective nuts, whereby the soundboard is secured to the inner rim. Alternatively, each of the bolts is securely embedded in the inner rim and is inserted into an associated one of the insertion holes of the soundboard from below, and then the nuts are fastened on the respective bolts from above, whereby the soundboard is secured to the inner rim. In these cases, the bolts and nuts correspond to first and second screws of the present invention.

It is further understood by those skilled in the art that the foregoing are preferred embodiments of the invention, and that various changes and modifications may be made without departing from the spirit and scope thereof.

What is claimed is:

1. An electronic musical instrument that generates a musical tone according to a musical tone signal generated based on an operated state of an operating element for musical performance, comprising:

a soundboard having a first end and a second end extending parallel to each other and secured to a predetermined part of the electronic musical instrument by a plurality of first screws and a plurality of second screws, respectively; and a vibration exciter provided on said soundboard and configured to vibrate said soundboard by being driven according to the musical tone signal to cause said soundboard to generate a musical tone, wherein the plurality of first screws and the plurality of second screws are arranged along respective first and second ends in a staggered manner such that a location of each of the plurality of first screws and a location of each of the plurality of second screws are not opposed to each other in a symmetrical relation in a direction orthogonal to the first and second ends, and wherein a cushion for suppressing resonance of said soundboard is disposed between said vibration exciter and said soundboard.

2. The electronic musical instrument according to claim 1, wherein the electronic musical instrument is an upright electronic piano in which the operating element is a key, wherein said soundboard is formed in a rectangular shape, and the first and second ends correspond to an upper end and a lower end of said soundboard, respectively, wherein the plurality of first screws and the plurality of second screws are arranged along respective upper and lower ends in a staggered manner such that a location of each of the first screws and a location of each of the second screws are not opposed to each other in symmetrical relation in a vertical direction, wherein a left end and a right end of said soundboard are secured to the predetermined part by a plurality of third screws and a plurality of fourth screws, respectively, and wherein the plurality of third screws and the plurality of fourth screws are arranged along respective left and right ends in a staggered manner such that a location of each of the third screws and a location of each of the fourth screws are not opposed to each other in a symmetrical relation in a left-right direction.

3. The electronic musical instrument according to claim 1, wherein the electronic musical instrument is an upright electronic piano in which the operating element is a key, wherein said soundboard is formed in a rectangular shape, and the first and second ends correspond to an upper end and a lower end of said soundboard, respectively, wherein the plurality of first screws and the plurality of second screws are arranged along respective upper and lower ends in a staggered manner such that a location of each of the first screws and a location of each of the second screws are not opposed to each other in symmetrical relation in a vertical direction, wherein a left end and a right end of said soundboard are secured to the predetermined part by a plurality of third screws and a plurality of fourth screws, respectively, and wherein the plurality of third screws and the plurality of fourth screws are arranged along respective left and right ends in a staggered manner such that a location of each of the third screws and a location of each of the fourth screws are not opposed to each other in a symmetrical relation in a left-right direction.

* * * * *